US007758053B2

(12) United States Patent
Wylie et al.

(10) Patent No.: US 7,758,053 B2
(45) Date of Patent: Jul. 20, 2010

(54) SKATE STRIP-BLADE HOLDER

(76) Inventors: Douglas H. Wylie, 278 Kerrybrook Drive, Richmond Hill, ON (CA) L4C 3RI; David G. Nelson, 1210 Fox Cres., Milton, ON (CA) L9T 6C5

( * ) Notice: Subject to any disclaimer, the term of this patent is extended or adjusted under 35 U.S.C. 154(b) by 804 days.

(21) Appl. No.: 10/595,801

(22) PCT Filed: Nov. 12, 2004

(86) PCT No.: PCT/IB2004/004458

§ 371 (c)(1),
(2), (4) Date: Mar. 7, 2007

(87) PCT Pub. No.: WO2005/094160

PCT Pub. Date: Oct. 13, 2005

(65) Prior Publication Data

US 2008/0001369 A1 Jan. 3, 2008

Related U.S. Application Data

(60) Provisional application No. 60/519,435, filed on Nov. 12, 2003, provisional application No. 60/588,823, filed on Jul. 16, 2004, provisional application No. 60/604,664, filed on Aug. 26, 2004.

(51) Int. Cl.
*A63C 1/00* (2006.01)
*A63C 1/30* (2006.01)
*A63C 1/04* (2006.01)

(52) U.S. Cl. ..... 280/11.12; 280/28; 280/11.18

(58) Field of Classification Search ..... 280/11.12, 280/11.18, 811, 11.16, 11.17, 28
See application file for complete search history.

(56) References Cited

U.S. PATENT DOCUMENTS

| | | | | |
|---|---|---|---|---|
| 630,810 | A * | 8/1899 | Kidder | 280/28 |
| 2,108,128 | A | 2/1938 | Kinney | |
| 2,150,964 | A | 3/1939 | Domseif | |
| 3,947,050 | A * | 3/1976 | Isely | 280/11.18 |
| 4,074,909 | A | 2/1978 | Bailie | |
| 5,088,749 | A * | 2/1992 | Olivieri | 280/11.18 |
| 5,123,664 | A * | 6/1992 | DeMars | 280/11.18 |
| 5,383,674 | A * | 1/1995 | Cann et al. | 280/11.18 |
| 5,988,683 | A * | 11/1999 | Venier et al. | 280/841 |
| 6,419,241 | B1 * | 7/2002 | Chenevert | 280/11.18 |
| 2005/0212227 | A1 * | 9/2005 | Pham et al. | 280/11.18 |

FOREIGN PATENT DOCUMENTS

| | | |
|---|---|---|
| CA | 288367 | 4/1929 |
| CA | 20225600 | 2/1992 |

* cited by examiner

*Primary Examiner*—Lesley Morris
*Assistant Examiner*—John R Olszewski
(74) *Attorney, Agent, or Firm*—Duane, Morris LLP; Steven E. Koffs

(57) ABSTRACT

An ice skate strip-blade holder that provides a means to remove, replace, tension, and maintain tension in a strip-blade fastened and tensioned on the holder. In a preferred embodiment, the strip-blade holder assembly includes a front segment fixed to the skate plastic superstructure; a latched, pivoting rear segment arranged to apply and maintain tension in the strip-blade. In a preferred embodiment, the pivot and latch are positioned such that the pivot carries the majority of the tensile load maintained in the strip-blade and the latch carries a minor component of this tensile load. This arrangement provides for easy latch release. The latch provides release of the rear segment for subsequent pivoting and unhooking of the strip-blade for replacement.

25 Claims, 14 Drawing Sheets

SKATE STRIP-BLADE HOLDER

This application claims the benefit of U.S. Provisional Patent Application Nos. 60/519,435 filed Nov. 12, 2003, 60/588,823 filed Jul. 16, 2004, and 60/604,664, filed Aug. 26, 2004.

BACKGROUND

It is usually desired to minimize the mass of any footwear and this is especially true for footwear used in competitive sports such as ice hockey and figure skating. The mass of a steel blade conventionally used for ice skates is significant and comprises a large component of the mass of the overall skate assembly. Strip-blade technology has been used for many years, an example of such a blade technology is described in U.S. Pat. Nos. 2,150,964 and 3,947,050 which are incorporated by reference herein in their entireties, and whereby the strip-blade is hooked or otherwise connected at each end and tensioned over the rocker of the strip-blade holder. As described by these patents, tension in the strip-blade is required to meet the desired requirements of skating.

Prior art strip-blade technologies utilized relatively massive and complex blade tensioning mechanisms. As a result, this technology does not offer a significant weight reduction. The pre-sharpened strip-blades are typically sold in pairs at retail stores and vending machines to be mounted by consumers on skates equipped with the special mounting fixture and blade-tensioning device. The technology has gained limited popularity based upon other benefits, as follows. The strip-blades are made available to consumers at a price approximately the same as it costs to sharpen conventional skates that utilize conventional single piece steel blades. As such, the strips are typically disposed after they become dull from use. The consumer then replaces the dulled strip-blades with newly purchased pre-sharpened strip-blades. It is thus more convenient for the consumer to use the strip-blades then to have his or her skates re-sharpened. Furthermore, the pre-sharpened strip-blades are typically sharpened on accurate and repeatable factory machines that provide much higher reliability in sharpening quality then the sharpening typically done at ice rinks, arenas, and sporting goods shops—usually by unskilled operators utilizing poor equipment.

Thus, the strip-blade technology provides a convenient and preferred method of procuring high quality sharp blades over conventional re-sharpening. This is important because reliable blade sharpness is a key factor for consistent, maximum performance for hockey and figure skating, for example. Spare strip-blades can be kept on hand, ready for use as soon as blades in use become dull. This avoids the undesired consequence of skating on dull blades because the skater was unaware of the need to sharpen his or her skates. This occurs frequently because the rate of dulling is variable, as it depends on many factors, and thus knowing when to re-sharpen is unpredictable. Replaceable strip-blade technology provides an immediate fix to dull skate blades, even during a game or competition, whereas conventional sharpening technology is employed after the event—when it is too late. It also saves time otherwise waiting for skates to be sharpened.

The degree of success of the strip-blade technology has been limited due primarily to complexities in design in the holder and tensioning devices that resulted in excessive cost to manufacture and devices that are not convenient to use. Examples of such holder and tensioning devices are described in U.S. Pat. Nos. 2,108,128; 5,383,674; and 5,988,683, which are incorporated by reference herein in their entireties.

SUMMARY

Apparatus for attaching a replaceable blade to an ice skate, comprises a holder adapted to be mounted to a boot. The holder includes a fixed first portion and a second portion pivotally mounted to the first portion. The first and second portions include respective receptacles for receiving a first end and a second end of the replaceable blade, respectively. The replaceable blade is under tension when the second portion is aligned with the first portion, and the second portion is at an angle with respect to the first portion when the replaceable blade is free from tension. The holder has a member for fixing the second portion in alignment with the first portion.

OVERVIEW

Figure 1:
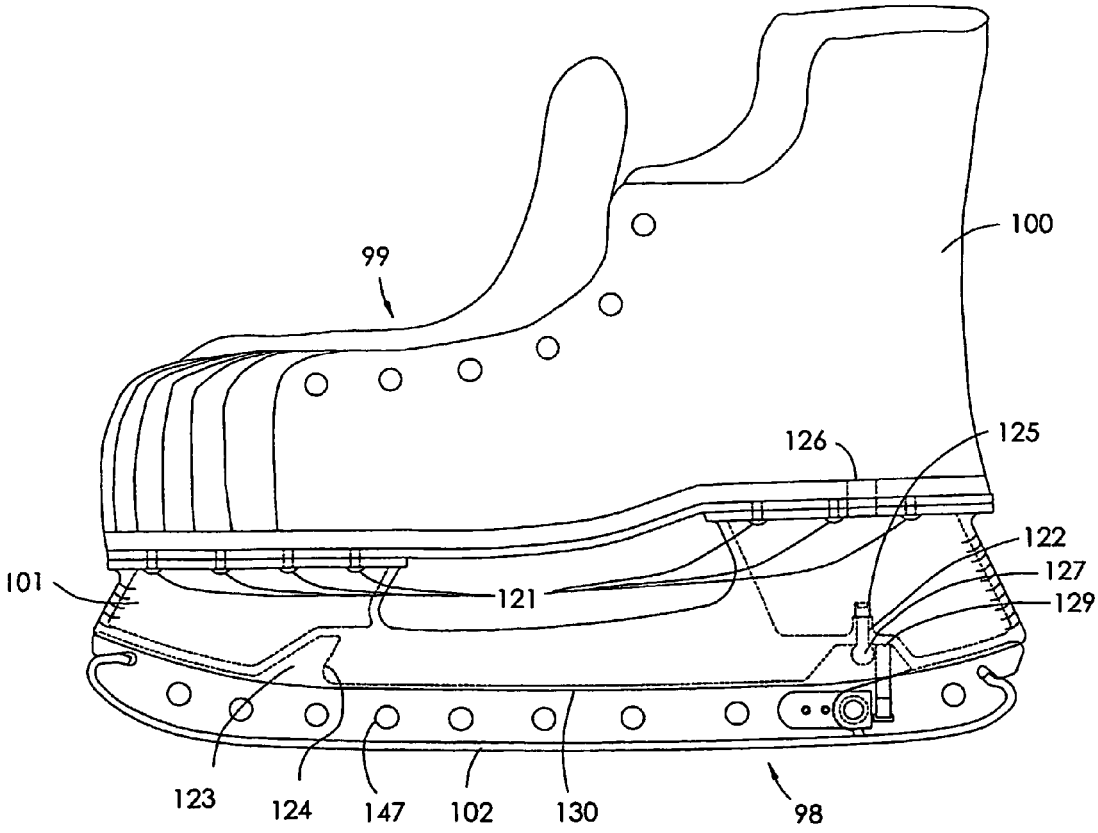
FIG. 1 is a side elevation view of a skate in accordance with an exemplary embodiment of the invention.

U.S. Provisional Patent Application Nos. 60/519,435 filed Nov. 12, 2003, 60/588,823 filed Jul. 16, 2004, and 60/604,664, filed Aug. 26, 2004 are incorporated by reference herein in their entireties.

An embodiment described herein reduces the mass of the steel blade by utilizing a smaller height strip-blade fastened to the bottom of a lightweight holder made of material such as aluminum or other materials such as steel with lightening (i.e., weight reducing) holes, for example. The use of replacement strip blades allows for larger lightening holes than conventional blades that require re-sharpening due to the fact that lightening holes for conventional blades reduce the life of the blade by reducing the number of sharpenings allowed before the edge sharpened by grinding reaches the lightening holes.

The exemplary embodiment overcomes prior art complexities by providing a superior means for blade removal, replacement and tensioning by utilizing a much simpler, convenient, design. The exemplary device provides for removal, replacement and tensioning that is integral to the removable strip-blade holder that takes the place typically occupied by a conventional solid steel or stainless steel blade. However, the exemplary embodiment is not limited to the same thickness and could be thicker or thinner, and could have a variety of profile shapes, other than the conventional skate blades rectangular profile.

The exemplary embodiment overcomes difficult design requirements. For example, the relatively high tensions required for the strip-blade, and the requirement for quick easy mounting, makes it difficult to conceive of any apparatus, device, or method to apply and maintain this tension in the very tight space of the skate strip-blade holder. The problem is made much more inconceivable given the fact that any tensioning device most likely will be subjected to high impact loading and high stresses during its use in hockey or figure skating, for example. In addition, the skate blade holder described below can be directly fastened to current skate plastic superstructure, designs, as described in U.S. Pat. No. 4,074,909 (which is incorporated by reference herein in its entirety), and number #14 in FIG. 1 of that patent, without having to change the molded skate plastic superstructure. This direct fastening reduces the cost to consumers to utilize strip-blade technology over designs requiring the removal of the plastic superstructure. In addition the blade holder described herein provides for unlatching of the tensioned strip-blades using a commonly available prying instrument such as a common screwdriver. Some embodiments are used in conjunction with a prying instrument by shaping a tab on the end of the strip-blade. In the preferred embodiment, means are provided for tensioning the strip-blade by exploiting the moment arm provided by the rear segment and a strategically positioned pivot. The arrangement minimizes the forces required to tension and latch the strip-blade. Preferably, the weight of the skater provides the means to tension the strip as he or she presses down on the heel of the strip-blade holder assembly to tension and automatically latch the strip-blade. A simple levering hand tool can also be used to tension and latch the assembly.

The mass of the preferred embodiment as specified herein for size 10 hockey skates was found to permit about a 50% reduction in mass over a conventional steel blade.

Figure 3:
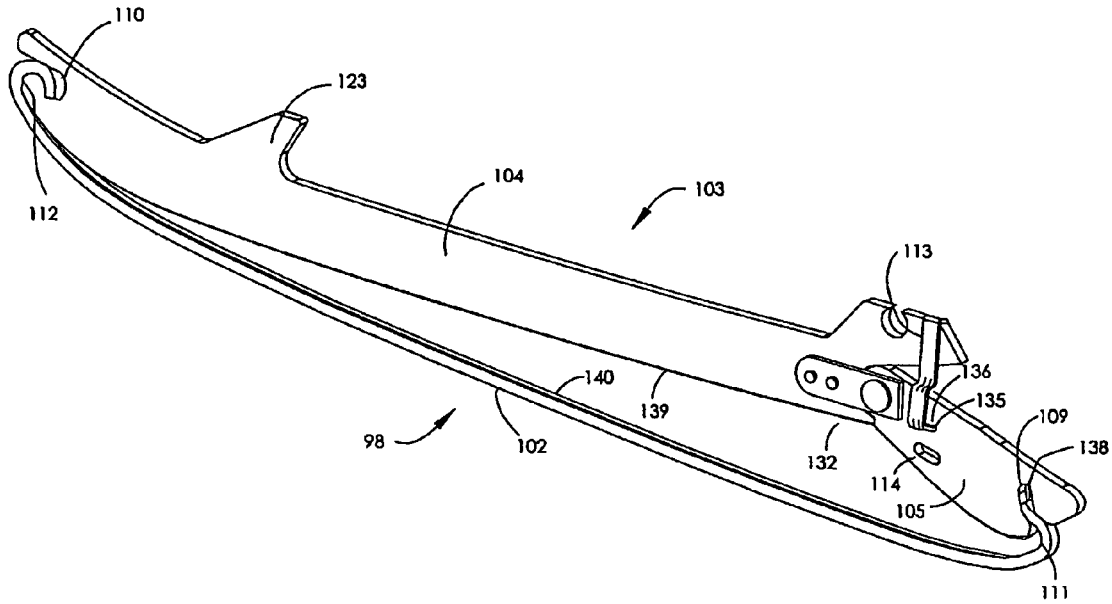
FIG. 3 is an isometric view of the strip-blade holder and replaceable blade shown in FIG. 1, with the blade in an un-tensioned state.
Figure 4:
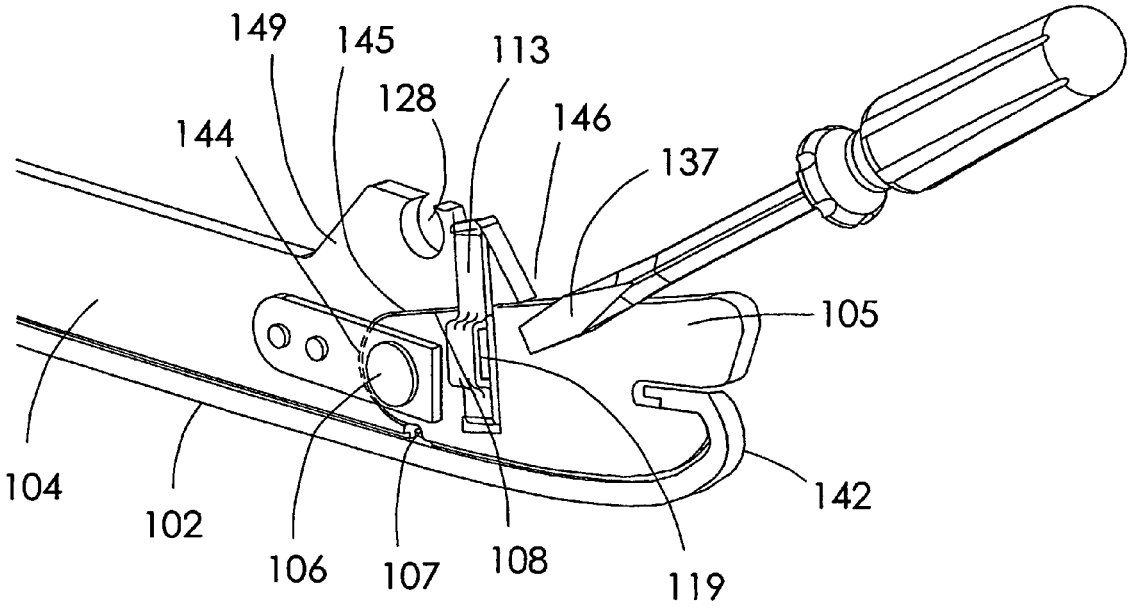
FIG. 4 shows the application of a tool to release the latch that holds the replaceable strip-blade in a tensioned state.

For the exemplary embodiment described herein, as shown in FIG. 1, a standard skate boot 100 and a skate boot plastic superstructure 101, as described in U.S. Pat. No. 4,074,909 re-utilized along with blade-strip 102 such as that described in U.S. Pat. No. 2,150,964, for example. The example provides a means of removing, replacing and tensioning the strip-blade 102 as follows. As shown in FIG. 3, the blade holder 103 is comprised of a front segment 104 and a rear segment 105. Segment 104 is fixedly secured to the sole of the skate boot 100 as described in U.S. Pat. No. 2,150,964, for example, while rear segment 105 is attached to segment 104 through pinned connections 132 which provides a secured pivot connection for segment 105. An engaging means is provided for engaging the first and a second end of the replaceable blade strip 102. The engaging means may include, for example, a pair of notches 109 and 110 at the front end of segment 105 and rear end of 104, respectively, but other detachable engaging means may be used, such as holes or depressions of various shapes, or jaws. Notch 107, shown in FIG. 4, in rear segment 105 and clearance gap 108 between front and rear segments allows rear segment 105 to rotate downward to effectively reduce the distance between hook slots 109 and 110 in segments 105 and 104 respectively. This reduced distance allows strip-blade 102 to be hooked by hand into slots 109 and 110 loosely without tension. Once strip-blade 102 is hooked into slots 109 and 110, rear segment 105 is rotated by hand upward which effectively increases the distance between hook slots 109 and 110. At a certain point in this rotation, the distance between the hook slots becomes equal to the distance between crotches 111 and 112 of the mounted strip-blade 102 and straining and tensioning of strip-blade 102 effectively begins. As further rotation occurs, additional elastic tension in strip-blade 102 occurs preferably up to approximately 250 pounds-force. At this point in the rotation, spring latch 113 automatically engages hole 114 in rear segment 105 thus latching the tension in the strip-blade to maintain it for skating and until the latch is released, as described below.

In a preferred embodiment, automatic latching is provided as follows: Latch 113 is preferably made of spring steel, such as hardened C1050 steel to Rockwell C45-C50, for example, or high tensile drawn 302 stainless steel wire, for example, and is composed of spring-arm 115, tab 116 and hook 117, shown in FIG. 5. Latch 113 is preferable secured by top U-clip 134 to segment 104 in a location and orientation to allow tab 116 to engage hole 114 at the desired point in upward rotation or rear segment 105, as described above. When unlatched, face 135 of tab 104 rides along the side face 136 of rotating segment 105 putting latch spring-arm 115 in elastic bending. This elastic bending force provides the latching force of tab 116 to automatically engage receiving hole 114 at the desired point in the rotation of segment 105. Once tab 116 is fully engaged in hole 114, hook 117 catches on the exit edge of hole 114 to latch the latch for added security in case the assembly is subjected to jarring impact.

The geometry of the pivot and hook slots is such that the majority of the reaction-force to tension from strip-blade 102 is carried by pin 118 because the force vector from the tensioned strip-blade passes in close proximity of pivot point 106. Latch 113 carries the light bending forces in strip-blade 102 and any minor load component resolved perpendicular to the aforementioned majority force vector that passes through pivot point 106. This arrangement results in a light latching force required, which make for easy unlatching of latch tab 116 in hole 114. Prying from behind spring-arm 115 at gap 119 with a prying instrument such as a common screwdriver unlatches the latch. Once unlatched, rear segment 105 pivots by hand around pin 118 thus releasing tension on strip-blade 102 and provides for strip-blade to be removed and replaced by hand. Once the new strip-blade is hooked at 109 and 110, tension in the strip-blade is preferably applied by the skater applying his or her weight force on the heel of the skate until latch 113 automatically latches, as described above. The relatively high tension force in the strip-blade of approximately 250 pounds is applied with a relatively low weight force due to the strategic arrangement of pivot 106 and slot 109 which provides levered advantage.

DETAILED DESCRIPTION

A preferred ice skate assembly is shown in FIGS. 1 through 5 A hockey skate assembly 99 is shown for illustration, but the exemplary structure can be applied to all ice skates including, for example, figure, power, etc.

Components are preferably assembled as follows: A superstructure (which may be conventional molded plastic superstructure 101 or other superstructure) is fastened (for example, with rivets 121) to skate boot 100. Front segment 104 of blade holder 103 is fastened to plastic superstructure 101 as conventionally done for example, utilizing 2 screws (not shown) or preferably using screw 122 or tab 123 as illustrated in FIG. 1. Rear segment 105 is connected to front segment 104 with a pin 118 to allow secured rotation of rear segment 105 around pin 118 to facilitate tensioning, removal and replacement of strip-blade 102, as described in detail in the paragraphs below. Both front segment 104 and rear segment 105 of blade holder 103 is snugly trapped for lateral support in groove 130, shown in FIG. 2, of plastic superstructure 101 (for example, as done conventionally with solid steel blades as described in U.S. Pat. No. 4,074,909). Socket head nut 125 secures screw 122 and attached rear segment 105 by bulge connection 129. Nut 125 is accessible for removal using a standard Allen key tool (not shown) through hole in sole of skate boot 126. Replaceable strip-blade 102 is tensioned axially and connected to blade holder 103 at hooked ends 109 and 110. Tongue and groove joint 131 along mating surfaces of holder 103 and strip-blade 102 provides lateral support at this interface. Tension in the strip-blade 102 is maintained by latch 113.

A preferred method of removing replaceable strip-blade 102 is as follows: any suitable prying tool 137, such as a common screw driver, as shown, is inserted into gap 119 between segment 105 and under latch spring-arm 115. Alternatively, a convenient prying tool can be made by grinding a flat prying section 138 on the end of the replacement strip-blade as shown in FIG. 3. The prying tool pries spring-arm 115 away from face 136 of rear segment 105 thus pulling latch tab 116 from latch hole 114 in rear segment 105. Once tab 116 clears hole 114, spring tension in strip-blade 102 pulls rear segment 105 downward slightly relieving tension in strip-blade 102. Once rear segment rotates slightly, face 135 of latch tab 116 abuts side face 136 of rear segment 105 and is supported under tension by bending tension of latch spring-arm 115. Prying tool 137 is then removed and rear segment 105 is rotated further by hand until strip-blade 102 can be loosely unhooked by hand from slots 109 and 110 as shown in FIG. 3. Tab face 135 rides along rear segment face 136 as rear segment 105 passes through its full open rotation of approximately 45 degrees. After a dulled strip-blade is removed a new pre-sharpened strip-blade is installed as described below.

A preferred method of installing replacement strip-blade 102 is a two step process as follows: The first step is for the skater to sit on a chair or bench, for instance, with the skate on his or her foot with strip-blade 102 removed from holder 103. He or she securely takes hold of rear holder segment 105 between index finger and thumb and opens it by rotating it approximately 45 degrees out of slot 130 and around pinned connection 131. This effectively shortens the distance between hook connection slots 109 and 110 of blade holder 103. New strip-blade 102 is hooked, by hand, into the ends of blade holder 103 at slots 109 and 110. Rear segment 105 is then partially closed by rotating it by hand upward to increase the distance between hook connections 109 and 110. This is done while ensuring tongue 139 enters groove 140 during rotation until tension is felt as a result of strip-blade 102 limiting rotational travel of rear segment 102 due to the-geometric relationship of specific components, as described below. Combined friction from the tongue and groove connection 141; latch tab face 135 pressing on rear segment face 136; and rear segment snuggly entering groove 130 of plastic superstructure 101 effectively holds the position of rear segment. At this point the assembly is ready for the second and final step for tension to be applied to strip-blade 102 and latching of latch 113. To accomplish this next and final step, the skater, stands up and, with their weight, presses the heel of the skate blade 142 against any firm surface, such as the floor they are standing on. This action continues closing rotation of rear segment 105 as tongue 139 enters groove 140 along the entire mating length of the strip-blade and strip-blade holder and rear segment 105 fully enters groove 130 of plastic superstructure 101. Tension to strip-blade 102 is thus applied, as described in detail below, until tab 116 aligns with mating hole 114. At this point in the rotation approximately 250 pounds-forces tension resides in strip-blade 102 and tab 116 automatically enters hole 114 by the force supplied by the elastic pre-load bending of latch spring-arm 115. Tab 116 enters hole 114 until the inner surface of spring-arm 115 stops by contact with side face 136 of rear segment 105. At this point, hook 117 at the end of tab 116 elastically sprints up to catch on the exit end of hole 114 at 143 to provide a latching of latch 113. Effectively at this home point, rear segment 105 is latched by latch 113 and latch 113 is latched by hook 117 to form a double latch. This double latch protects against latch 113 from being dislodged by any impact to blade assembly 98.

Tensioning of strip-blade 102 occurs during the closing of rear segment, as described above, due to specific geometric relationships between the components of holder assembly 98, as follows. As rear segment 105 is closed, the distance between slots 109 and 110 increases past the distance between crotches 111 and 112 of strip-blade 102 thus straining strip-blade 102 to tension it.

Alternative methods of closing segment 105 may be used by anyone skilled in the art of mechanical design. Such methods may include, for example, the use of pliers type tools conventionally used to extract retaining ring fasteners, for example (not shown). These types of tools provide for high leveraged mechanical advantage that overcomes the forces to close segment 105. Holes (not shown) to accept the tips of such tools would be required on either side of split 108 segment in the area between tangent arc 144 and notch 146. The exemplary method, as described herein, avoids the need and associated cost of such tools. Also, if the person is strong enough to apply approximately 30 pounds-force by hand, tensioning and latching can be accomplished by arm force.

Alternative latching means may also replace the latching means as described above. Such means may include a separate latch or key to hold closed segment 105 in the closed position. Such latch might straddle splits 108 in the area between tangent arc 144 and notch 146. Such separate latching devices are not required to be automatic and may require manual insertion. They may be completely detachable.

More detailed descriptions of both the preferred embodiments and other exemplary embodiments are described below.

A preferred strip-blade holder assembly 98 is comprised of components as follows: subassembly holder 103 comprising of segments 105 and 104; pin 118; and, latch 113. It is preferred to have the holder assembly 98 the approximate same height, length and thickness dimensions as a conventional new steel blade, but other dimensions may be used. Length is variable and dependent on size and type of skate. A smaller height holder assembly 98 is possible and may be desired for reduced weight or reduced stresses but it may be more difficult to provide space for slots 109 and 110 and space for latch 113. Holes 147 in holder 103 might be preferred if reduced weight is desired, but holes 147 are not necessary for functionality. Front segment 104 is connected to plastic superstructure 101 using the fasteners designed for use with the particular plastic superstructure. This fastening is typically accomplished using either two screws as described in U.S. Pat. No. 4,074,909 or a single screw and tab 123 as shown in FIG. 1. As illustrated, tab 123 hooks over receiving cavity 124 in plastic superstructure 101 to effectively retain front holder segment 104 in front while screw 122 and nut 125 holds holder segment 104 at its rear. Screw 122 passes through hole 126 in plastic superstructure and nut 125 threads onto screw 122 to effectively fasten front segment 104 to plastic superstructure 101. A circular shaped bulge 127 at the base of the screw fits into clearance hole 128 in holder segment 104 to form bulge connection 129. The thickness of screw bulge 127 is the same as the holder 103 to fit into slot 130 of plastic superstructure 101. Slot 130 in which holder 103 fits snuggly provides support to lateral loads applied when skating. Sometimes some plastic superstructure manufacturers use a screw and nut assembly instead of tab 118 (not shown). Utilizing a tab connection 123 to secure the holder at the front end is preferred to using a screw and nut assembly as it avoids the need to remove the plastic superstructure, by removing rivets 121, to access the nut that is otherwise inaccessible. When a screw is used (not shown) in place of tab 123, it typically utilizes the same circular bulge connection 129 in the holder 103 as illustrated. A variety of fastening methods may be used, such as those used by plastic superstructure manufacturers.

Removal of the holder assembly 98 from the plastic superstructure 101, as illustrated, is accomplished as follows: Threaded nut 125 is unscrewed and removed from screw 122. Holder assembly 98 is pulled by hand from its snug fit in plastic superstructure slot 130, pulling the attached screw 122 with it through passage 126. The holder assembly 98 is simultaneously pulled axially forward to unhook tab 123 from its receiving cavity 128 in plastic superstructure 101. Replacement of holder assembly 98 to plastic superstructure 101 is the reverse of the aforesaid operations to remove it. When a front screw is used (not shown) in place of tab 123, the plastic superstructure 101 is first removed from the sole of the boot 100 by removing rivet fasteners 121, typically used, for example.

Figure 5:
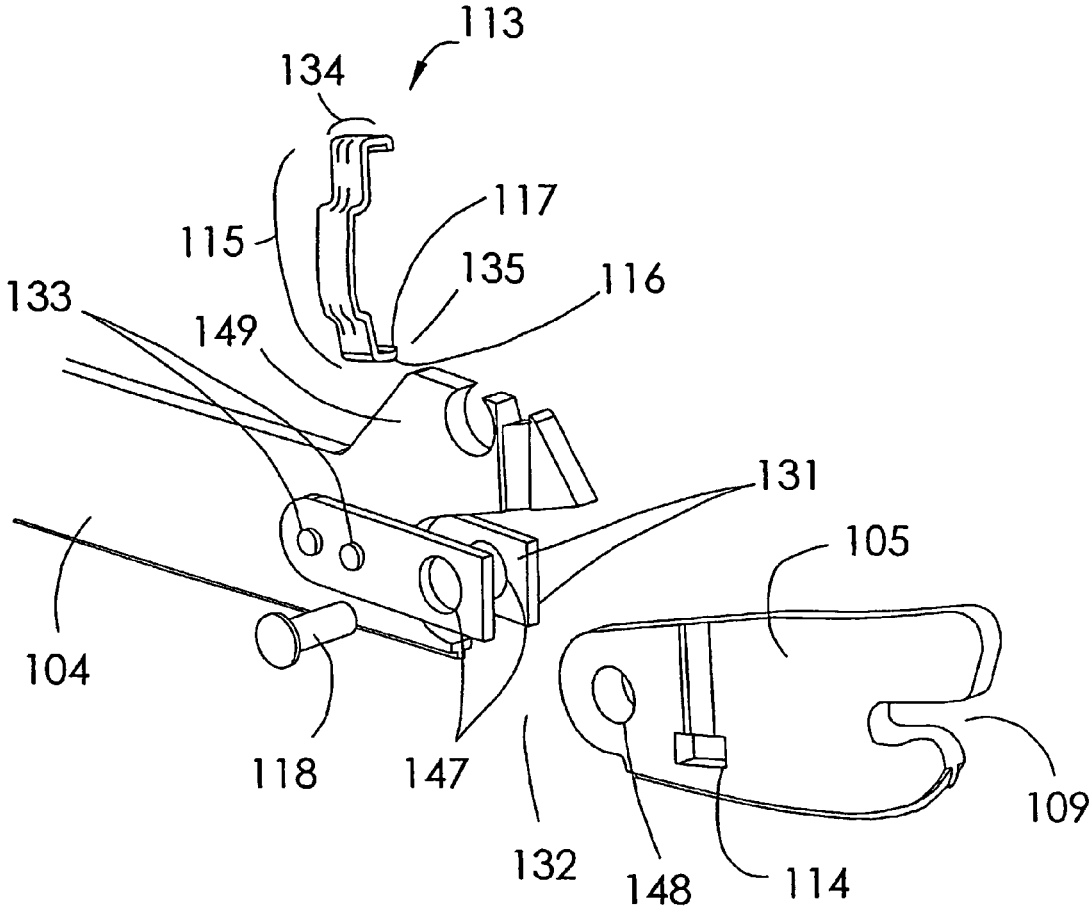
FIG. 5 is an exploded view of the strip-blade holder of FIG. 4.

In the preferred embodiment, rear segment 105 is connected to front segment 104 through a pinned connection 132, to provide a secured pivot. Holder 103 has a constant thickness (which may be approximately 0.115"), depending upon the particular plastic superstructure used, along its length to fit into plastic superstructure slot 130 as described above. An exemplary pinning design, as illustrated in FIG. 5 is to provide a clevis pin assembly 132, for example, by attaching two identical pin support brackets 131 to either side of front segment 104 using common fasteners such as rivets or bolts 133 to form clevis 132. Rivet pin 118 passes through holes 147 in clevis brackets 131 and aligned hole 148 in rear segment 105. The dimensions of the pin and clevis are sized to provide adequate bearing area for the pin under compression of the strip-blade tension to avoid exceeding the compressive strength of the component materials. For example, a pin with a diameter of 5 mm; and, a 6060 T6 aluminum clevis brackets 131; and, rear segment 105 with thickness 3 mm of the same material as clevis bracket 131, can withstand a tension of approximately 700 pounds force in strip-blade 102 without the material of pin connection 132 from yielding. A slight clearance between pin 118 and holes 147 allows the required free rotation of rear segment 105 around pivot pin 118.

Figure 8:
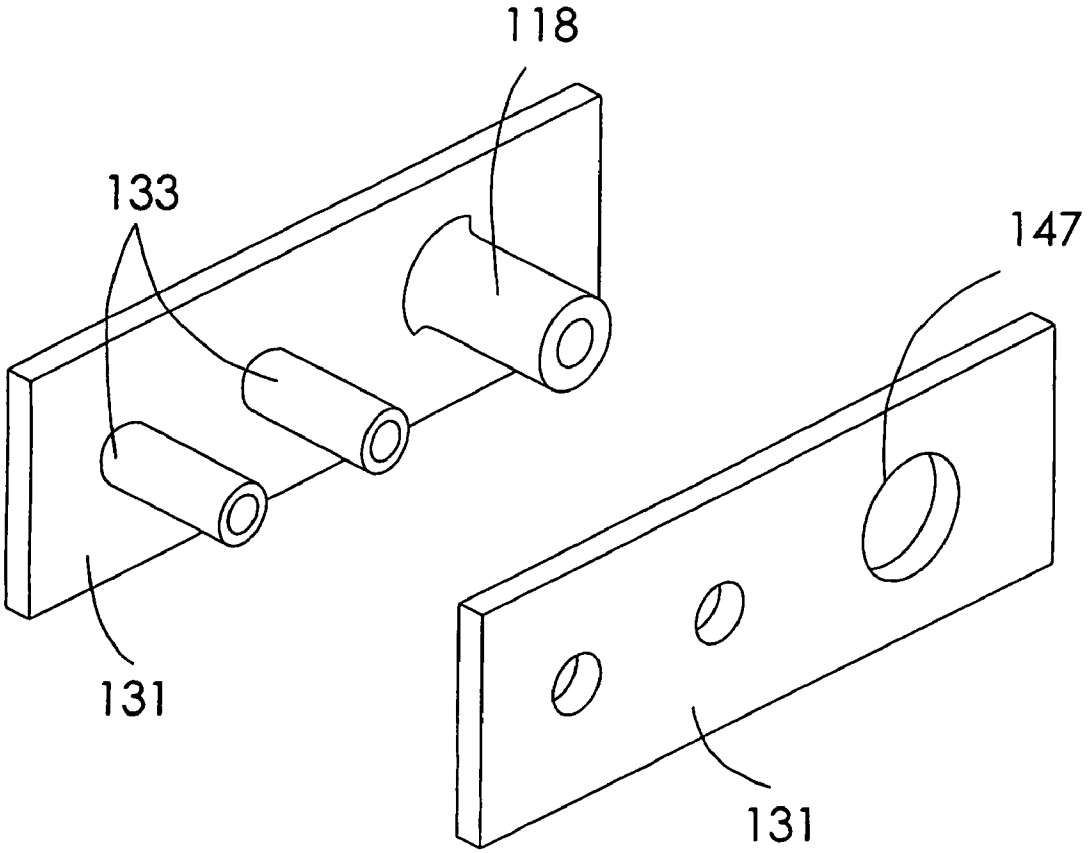
FIG. 8 is an isometric view of a portion of an exemplary clevis in accordance with an exemplary embodiment of the invention.

The preferred clevis design is shown in FIG. 8, whereby separate rivet pin 118 and separate rivet fasteners 133 are made integral by cold stamp forming, for example, to form one side of the clevis bracket 131. Rivet pin 1118 passes through hole 148 of segment 105 as shown in FIG. 5 (not shown in FIG. 8), while rivet pins 133 pass though receiving holes in segment 104. Hole 147 of other clevis bracket 131 is then mated over rivet pin 118 while holes 131 are mated over rivet pins 133. After such assembly the rivet pins are cold formed by stamping to form mushroom rivet heads and final pivoting clevis assembly connecting segment 104 to 105.

Other clevis or hinge connection designs may be used by someone skilled in the art of design.

Pinned connection 132 provides pivot rotation and retention of rear segment 105 when strip-blade 102 is removed. Pinned connection 132 also prevents segment 105 from pulling out of groove 130 if a pulling force to strip-blade 102 is ever applies when strip-blade 102 is installed and tensioned. As mentioned above, connection 132 provides a means to rotate rear segment 105 to effectively shorten the length of holder 103 to facilitate removal and replacement of strip-blade 102, as described above.

Other pivot arrangement (not shown) are possible, for example whereby clevis 132 is removed resulting in rear segment 105 to bear on front segment 105 at arced radius bearing surface. In this embodiment, front segment 104 is shaped to provide a matched radius bearing surface 154. This bearing surface and arrangement provides for unsecured pivot rotation or rear segment. The rear segment 105 can be completely detached after strip-blade 102 is removed. The preferred clevis 132, as mentioned above, provides for secured pivoting of rear segment 105.

Figure 9:
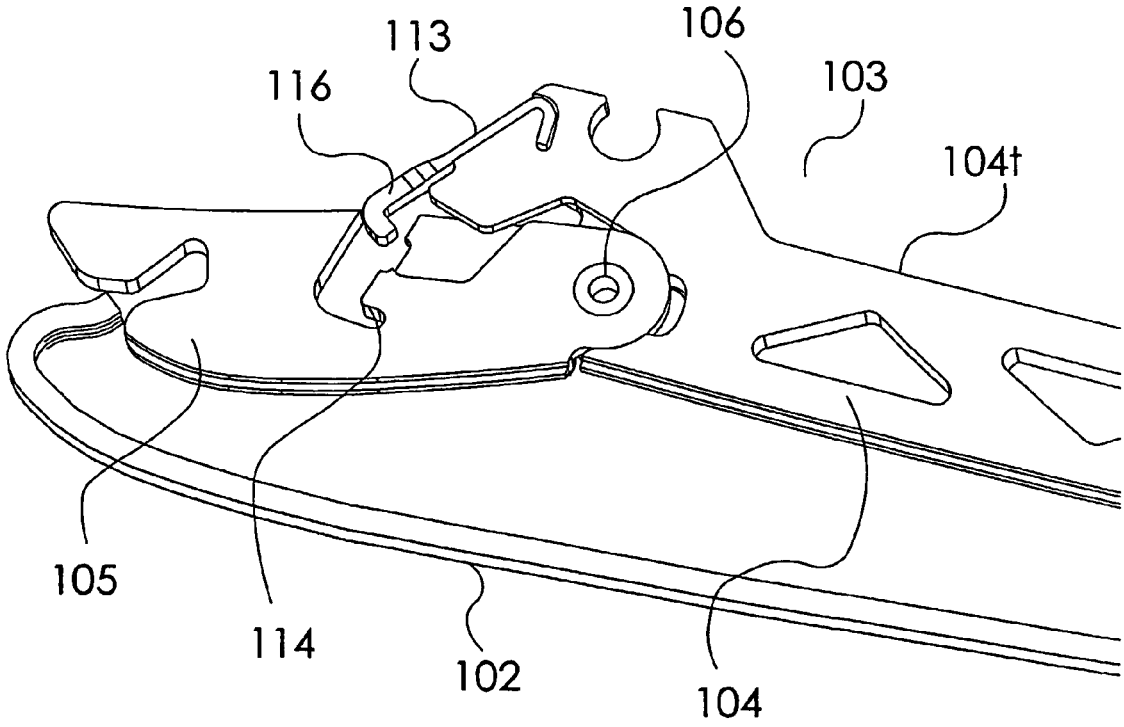
FIG. 9 is an isometric view of another exemplary pivot design and another exemplary latch design.
Figure 10:
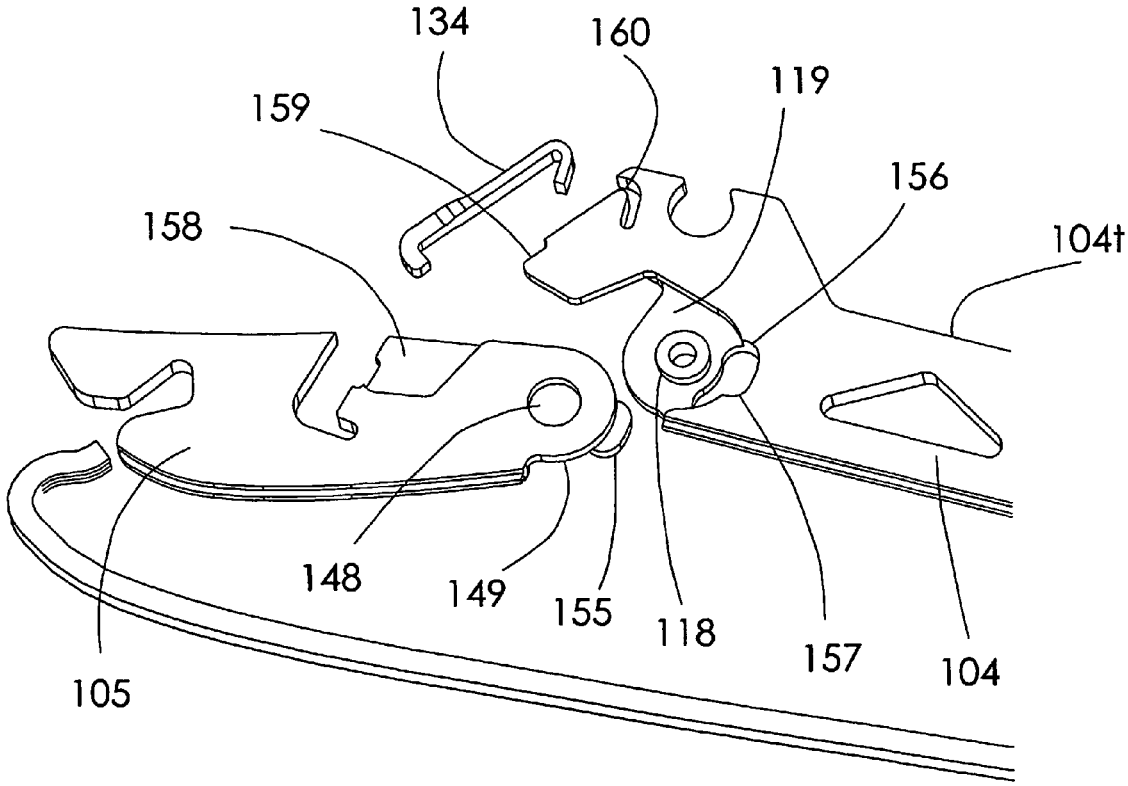
FIG. 10 is an exploded view of the pivot and latch of FIG. 9.

A variation of the above pivot design is shown in FIGS. 9 and 10 wherein pin 118 is integral to front segment 104. Note however, that pin 118 could also be made separate, as a rivet, for example, as described in other examples herein and shown in FIG. 5, for example. In the exemplary clevis or pivot design as illustrated in FIGS. 9 and 10, mating interleaving faces are cut or formed, for example, into segments 104 and 105 in two areas, as follows.

The thickness of a portion 119 of segment 104 surrounding pin 118 is less than (e.g., approximately one half of) the thickness of the major portion 104*t* of segment 104. The major portion 104*t* includes all of segment 104*t* except the lightening holes, tongue 139 (FIG. 3), groove 110, (111 on 105), and clip containment slot 160 and the mating interleaved faces. A mating interleaving face 149 is provided on the rear major surface of segment 105 in the area of hole 148. Preferably, the combined thicknesses of faces 119 and 149 are substantially the same as the thickness of the major portion 104*t* of segment 104. The other pair of interleaving faces 158 and mating face 159 are provided on segments 105 and 104, respectively. Each of these portions has a thickness less than (e.g., approximately one half of) the thickness of the major portion 104*t* of segment 104. Portion 158 is on the front major surface of segment 105 (whereas portion 149 is on the rear major surface of segment 105). Portion 159 of segment 104 is on the front major surface of segment 104 (whereas portion 119 of segment 104 is on the rear front major surface of segment 104. Thus, each segment 104 and 105 has two mating portions on opposite major surfaces of that segment.

As illustrated, the mating interleaving faces (158 mating with 159, and 119 mating with 149) in the two areas on the two segments 104 and 105 oppose each other, as shown, to provide joint rigidity to the assembled segments 104 to 105 when the faces 158 and 159 are engaged. This engagement occurs by rotating segment 105 around pin 118 into a latched position. This interleaving arrangement provides exceptional strength at this pivoting clevis or hinge.

FIGS. 9 and 10 also show an exemplary pin securing arrangement whereby bayonet style latching tab 155 enters hole 156 in segment 104, while segment 105 is in the rotated orientation shown in both figures, and pin 118 simultaneously enters hole 148. A portion 157 of segment 104 is also of a reduced thickness. The portion 157 is on the front major surface of segment 104, and tab 155 is on the rear major surface of segment 105. Once pin 118 engages hole 148, and tab 155 enters hole 156, and segment 105 is rotated upward, then tab 155 interleaves with mating face 157 in segment 104 to secure segment 105 to 104 in interleaving action. The bayonet style locking tab is a means for providing lateral support strength between the first and second portions in alignment.

Also shown in FIGS. 9 and 10 is an alternative embodiment of latch 113. In this exemplary embodiment, latch U-clip 134 clips into containment slot 160. After installation, the U-clip 134 is surrounded on front and rear major surfaces by skate boot plastic superstructure 101 (shown in FIG. 1), so that clip 134 does not become dislodged. Note however, latch 113 could also be integral to segment 104 for example (not shown), by laser cutting, for example which would avoid the need for u-clip 134 and mating slot 160. Note also slot opening 160 and opening around latch 113 in segment 105 can be made webbed for increased strength over openings that are fully cut-through.

In these alternative embodiments, latch 113 is oriented such that the spring latching action, as described above for other embodiments, is in the plane of the strip blade holder 103. As illustrated in FIGS. 9 and 10, for example, latch tab 116 latches on latch tab catch or hole 114 in rear segment 105. Release of latch 113 when in its latched position (not shown) can be easily accomplished by prying with a key or common screwdriver action, for example, as described above. Latching segment 105 to latch 113 is accomplished by stepping or pushing on the heel of segment 105 with strip blade engaged, as also described above, for example.

Figure 2:
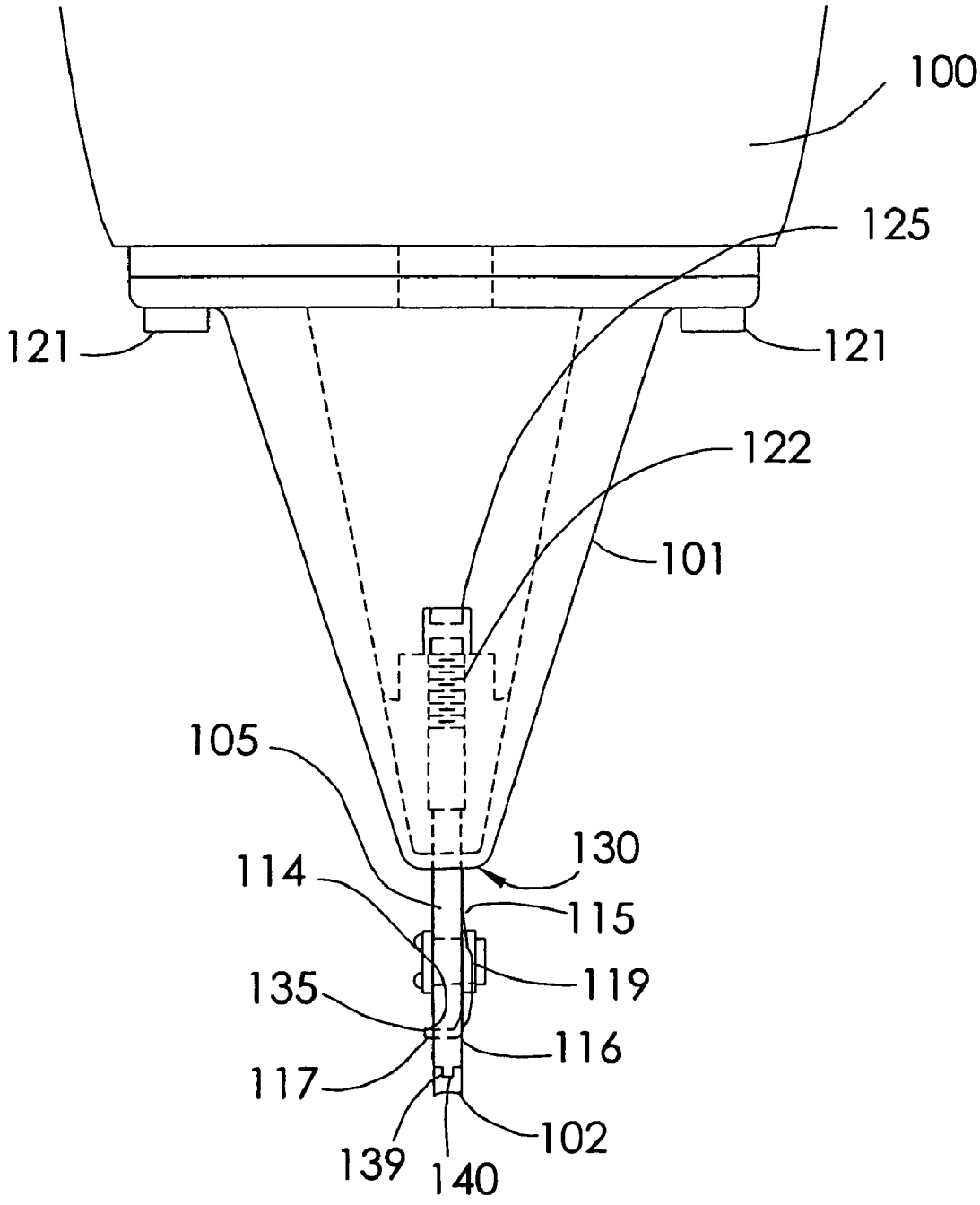
FIG. 2 is a rear elevation view of the skate shown in FIG. 1

Although other locations are possible, the preferred location for pivot point 106 is as shown in FIG. 1, FIG. 2, and FIG. 3 which is in the area below hole 128. This location provides for the following: split 108 arrangement to provide pivoting of rear segment 105; space for latch 113 behind hole 128; and, preferred force vector alignment, as described below. The arrangement of pivot 106; split or clearance gap 108 and latch 113 provides a means required for tensioning, latching, removing and replacing strip-blade 102. Details of this arrangement are as follows: Split or clearance gap 108 separating front and rear segments 104 and 105 respectively strategically terminates at notch 146, at one end, and below pin pivot point 106, at the other end. Split 108 comprised, in part by arced segment 144 behind pivot point 106 to provide for rotation of rear segment 105 and straight section 145 between upper tangent point of arc segment 144 to notch 146. Notch opening 107 in split 108 below pivot point 106 provides for rear segment 105 to rotate without interference with front segment 104. Notch opening 107 is preferably sized such that at the extent of rotational travel of rear segment 105 provides for easy hooking of strip-blade in slots 109 and 110. Split 108 at section 145, shown in FIG. 4, preferably runs tangent from arced segment 144 to notch 146 of rear segment. This arrangement of split 108 and latch 113 provides for the reaction force from the tension in strip-blade 102 to be taken almost entirely by pivot point 106 which helps minimize force on latch for release. This split path arrangement also allows the top of latch 113 to be connected to fixed front segment lobe 149 of front segment 104 by hooking over the top of lobe 149. Alternatively, or in addition, a fastener such as a rivet could be used.

Figure 6:
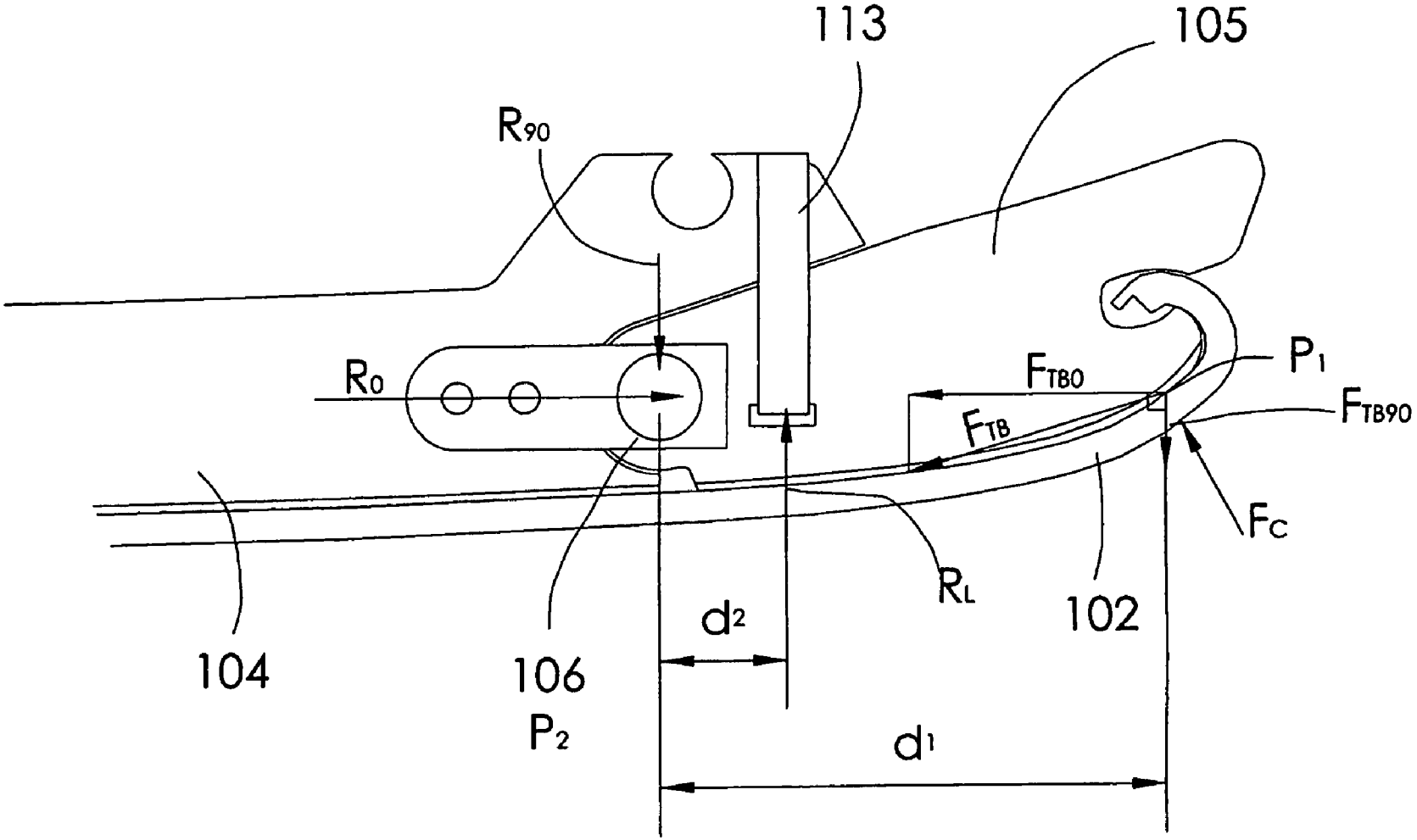
FIG. 6 is a diagram showing the force balance on the blade holder of FIG. 1.

The free-body force diagram as shown in FIG. 6 depicts the force arrangement on segment 105 of the exemplary embodiment. This diagram illustrates the strategic arrangement of components of assembly 98 to achieve the combination of low latching force, and low closing force required on segment 105 to achieve the high latched tension force in strip-blade 102. Referring to FIG. 6, force vector from strip-blade 102 is labeled $F_{TB}$ has resolved component force vectors $F_{TB0}$, which runs through pivot point 106, and $F_{TB90}$ directed perpendicular to $F_{TB0}$. Closing force vector $F_C$, acts at the heel of segment 105 at approximately the same point of connection between strip-blade 102 and segment 102, labeled $P_1$, where $F_{TB}$ also acts. $d_1$ is the perpendicular distance between $F_C$ (or $F_{TB90}$) acting at point $P_1$, to point $P_2$, which is the center of pivot point 106. Also shown are reaction force vectors $R_0$, resolved parallel to $F_{TB0}$, and $R_{90}$ resolved perpendicular to $R_0$. These reaction force vectors are provided by pin connection 132. Latch reaction force vector $R_L$ is shown and acts approximately perpendicular to $F_{TB0}$. $d_2$ is the perpendicular distance from $R_L$ and $P_1$. Closing force $F_C$ is applied to close segment 105 and is released once latching occurs whereby $R_L$ maintains the forces in equilibrium.

By inspection of the free-body diagram of FIG. 6, the majority of the tension in strip-blade 102 is carried by pin 118 by reaction force vector $R_0$ as illustrated by $F_{TB0}$ being large in comparison to $F_{TB90}$. By summing the moments around pivot point $P_1$ before latching force vector $F_C$ holds tension, $F_C$ approximately equals the relatively small force $F_{TB90}$. This force was found to be approximately 133 newtons (30 pounds-force) to achieve 890 newton (200 pounds-forces) in strip-blade 102. Thus a small (30 pound-force) closing forces is required to achieve a relatively high strip-blade tension (200 pounds-force). Even a small child can easily apply this closing force with his or her weight, as described above. Summing the moments around $P_1$, when assembly 98 is in the latched condition, after which closing force $F_C$ is released, determines the magnitude of latch reaction force vector, $R_L$ acting approximately parallel to $F_{TB90}$. Solving for $R_L$ by approximating the coefficient of friction between latch tab 116 and the mating surface of hole 114 to be 0.5 and inputting the ratio of $d_2/d_1$, measured to be 5 on a prototype sample of assembly 98, equates $R_L$ to be approximately 30 pounds force. Even a short prying instrument easily overcomes this force to unlatch latch 113, which was confirmed with a "proof-of-principle" prototype of assembly 98.

Many standard materials and methods of fabrication are possible for holder 103 with varying degrees of cost and performance. The design must provide for stresses anticipated, including the compressive load at pivot point 106 and latch 113. Anyone skilled in calculation of stresses and selection of materials and manufacturing process can effectively evaluate and determine preferred materials and methods of manufacture depending on desired specific material strength and stiffness and cost. Generally a preferred material for holder 103 is 6061 T6 aluminum for cost effectiveness, machinability and material properties such as flexural modulus and strength. It can be machined using a standard milling machine or CNC milling machine, for example. Such material can be anodized or coated to a variety of colors, if desired. Any other suitable material or alloy can be used such as magnesium, titanium or steel in virtually any grade. A preferred such stainless steel traditionally used for ice skate blades is 12C-27 supplied by Sandvik A B, located at SE-811-81 Sandviken, Sweden, hardened to 40 to 60 on the Rockwell C scale. Other material options include molded thermoset composite material such as glass epoxy, carbon epoxy, or molded thermoplastic composite material such as glass nylon, glass polycarbonate, carbon nylon, carbon polycarbonate, for example. Either continuous strand composite or chopped long or short fiber composites are possible materials. Other materials such as molded or milled non-reinforced thermoplastic material or wood could be used in limited light duty applications as they do not offer the preferred specific strength and modulus offered by metal alloys and composites.

The shape of the bottom of the holder 103 in terms of rocker can take any desired shape while strip-blade 102 is made to conform to follow this shape either flexibly or exactly. Connection of strip-blade 102 to holder 103 at the ends can be accomplished by any of the methods described in the referenced patents, for example.

Figure 7:
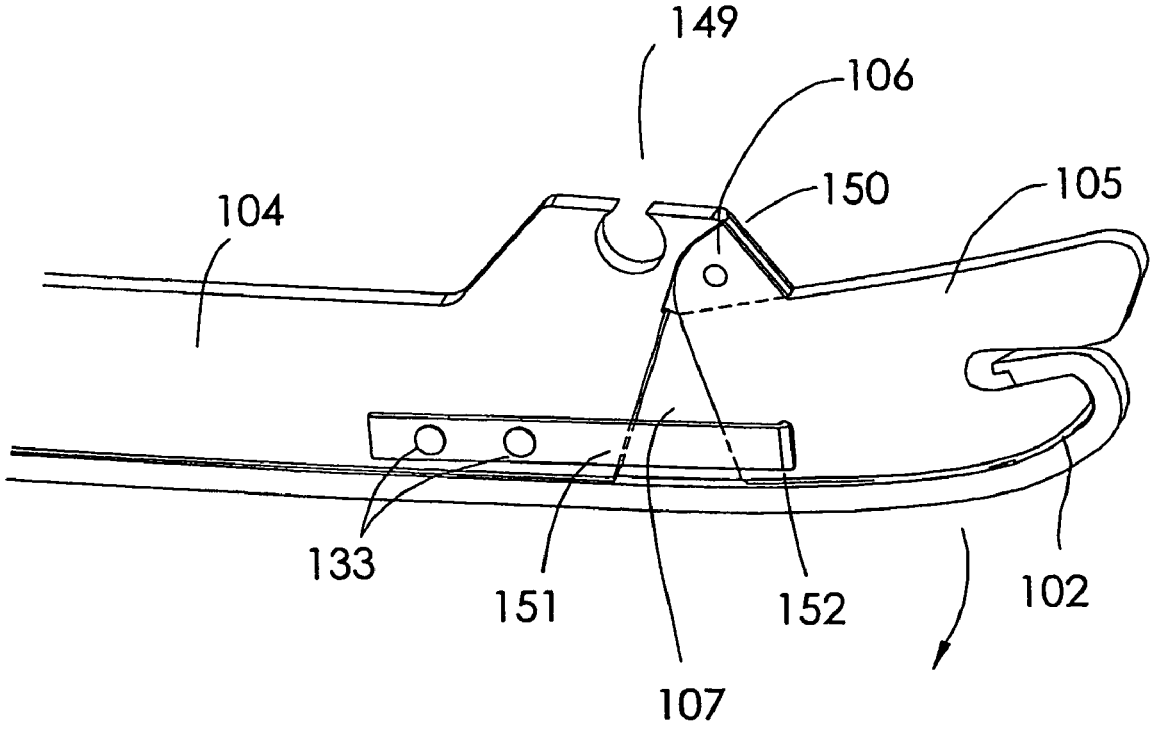
FIG. 7 is an isometric view of the strip blade holder according to another exemplary embodiment of the invention.

Alternative locations for pivot 106 and latch 113 are possible and one such exemplary arrangement is shown in FIG. 7. As shown, pivot 106 is located in lobe 149; notch 107 is enlarged to provide required rotation of rear segment 105; and latch 151 is oriented to hold segment 105 in position to tension strip-blade 102. In this arrangement latch tab 152 carries most of the load in reaction to the tension in blade strip 102. Clevis 150 is formed by a groove in the lobe area of rear segment 105 and a tab formed in the lobe area of 104 with pin at pivot 106. Latch 151 is fastened to segment 104 by rivet fasteners 153, for example. In other embodiments (not shown) the pivot for the movable segment on the blade holder 103 could be positioned anywhere on the holder 103 whereby a suitable moment arm is provided for tensioning the strip blade to the desired amount. The pivot point location may include the point that coincides with the mounting fastener that fixes the blade holder 103 to the superstructure 101.

It is preferred to manufacture holder assembly 103 by automated methods using single flow processing whereby parts progress continuously in a single flow pattern through a series of process steps. An exemplary method is as follows: sheet metal, in final thickness form from coil stock is straightened and leveled (preferred), or from blank stock from a magazine supply, for example, is fed by conveyor (preferred) or robot, for example, into a stamping press (preferred) or numerically controlled (CNC) mill, for example. In the press, or mill, all edge surfaces are cut except for the bottom edge with tongue 139, but including all holes. From the press, a conveyor (preferred) or robot, for example, transports the partially cut stock, to the next process step, whereby clevis assemblies as shown in FIG. 8 are positioned in final location and riveted onto each holder 103 in the continuous flow of parts. The next step is to fasten latch 113 onto lobe 149 and engage tab 116 into hole 114. Positioning the clevis brackets 131 and the latch 113 in the previously described steps might be done with a robot, for example, but preferably is carried and positioned by an indexing web carrier and cut, for example, from the web upon mating in position with holder 103. The next, and final step, after the partial assembly is transferred, is to cut the rocker shape and tongue 139 to the bottom of holder 103 using CNC milling process, for example, while the assembly is clamped for accurate positional cutting. After the mill cutting has completed the loop, assembly 103 will be free of the blank carrier and be carried for packaging by conveyor, for example.

Figure 11:
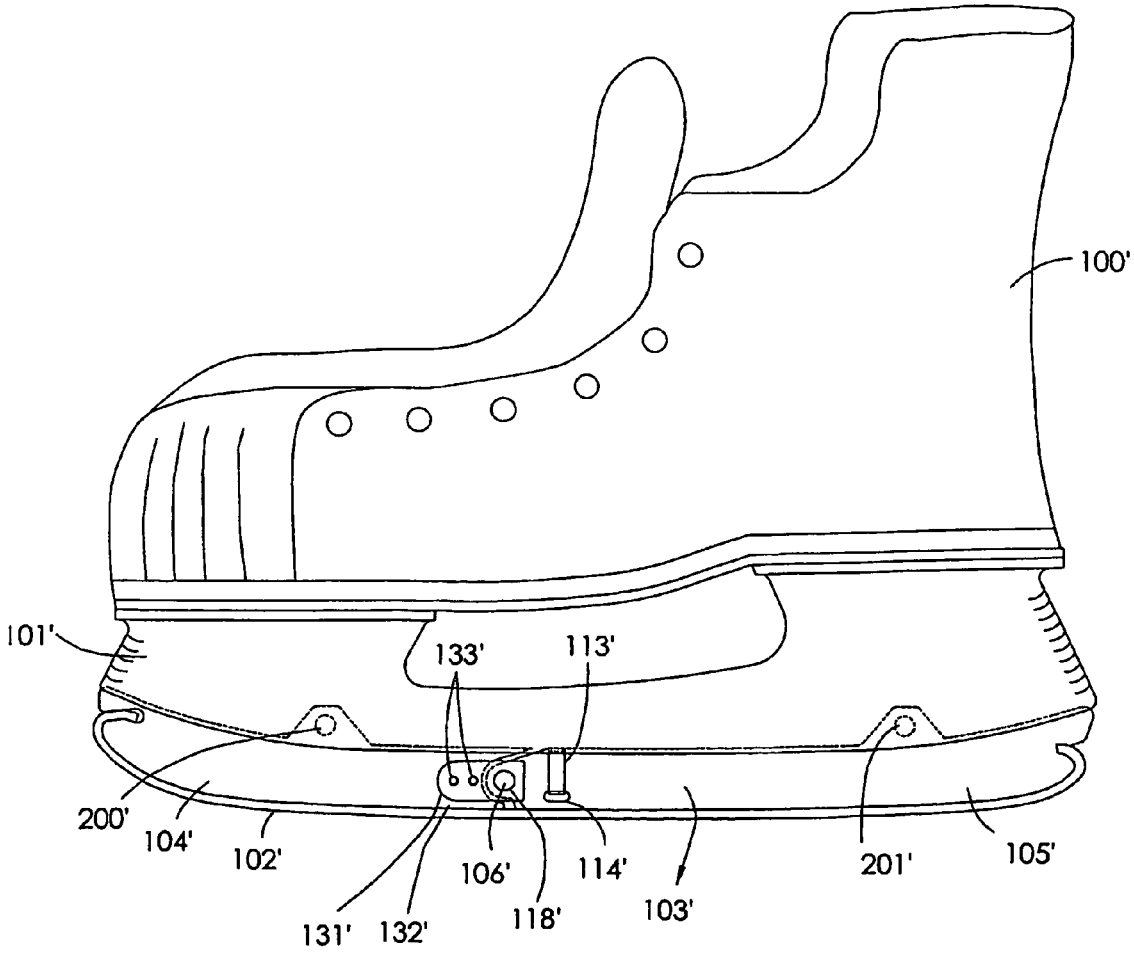
FIG. 11 is a side elevation view of a skate having another exemplary embodiment of the strip blade holder.

FIG. 11 shows another embodiment of a blade holder, in which items which are like or similar to those described above are indicated by a prime ('). Pivot point 106' is split between holder segments 104' and 105', and the clevis or hinge 132' and clip 113' are moved forward relative to that shown in FIGS. 1-7. That is, the clevis 132' is located nearer to the toe end of the boot 100' and between fasteners 200' and 201'. Longer rear segment 105' provides greater leverage for easier tensioning. This configuration provides a longer lever arm (the length of segment 105') on which the user applies pressure, to force the pivoting rear segment 105' of the blade holder 103' into a position of alignment with the fixed front segment 104' of the blade holder 103', and thus requires a smaller upward force on the heel of segment 105' than is required to attach the blade strip 102 in the embodiment of FIG. 1. It is also contemplated by the inventors (not shown) to reverse the hinging action to have rear segment 105' fixed to superstructure 101' by fastener 200', while front segment 104' rotates to facilitate strip blade 102' loading and tensioning.

As shown in FIG. 11, the front segment 104' of the blade holder 103' may be attached to the plastic superstructure 101', by a bolt 200', or other fasteners. One or more additional fastener(s) (not shown) could also be used for added stability. When one fastener is used, as shown, the upper edge of blade holder 103' is fixed rotationally around fastener 200' by the base of groove 130 (shown in FIG. 2) in plastic superstructure 101'. The larger rear segment 105' of the blade holder 103' is pivotally attached to the superstructure 101', with pin or bolt 201', or other fastener, for example. In one preferred embodiment, the pin, bolt, or other fastener 201' can be used with a clip 113' in combination, with the pin, bolt or other fastener 201' backing up the clip 113' for securing the rear blade holder segment 105' to the superstructure 101'. In other embodiments, only one or more clips 113' alone is (are) used to secure the blade strip 102'. In still further embodiments, only one or more pin(s) and/or one or more bolt(s) 201' and/or one or more fasteners of another type are used to secure the pivoting rear segment 105' of the blade holder in its aligned position (without the clip).

Figure 12:
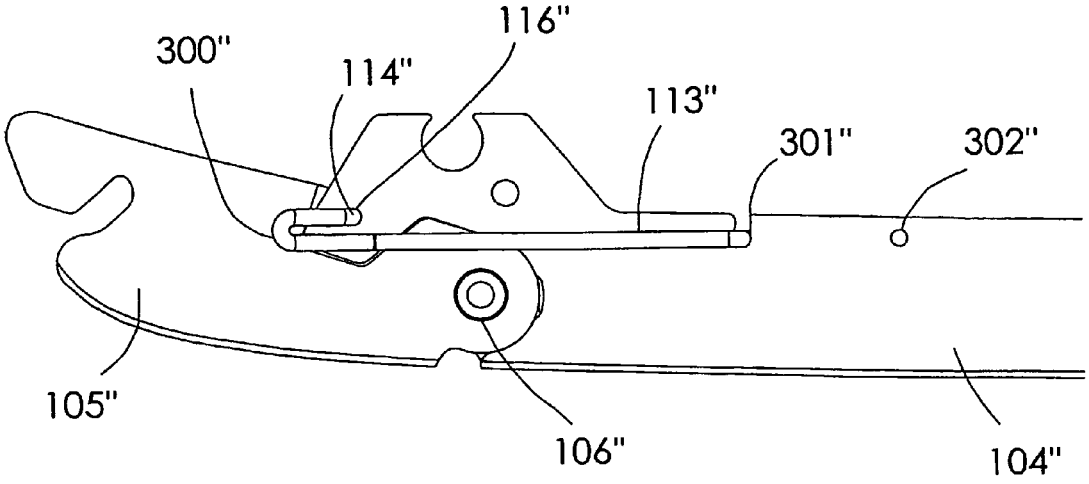
FIG. 12 is a partial side elevation view of a variation of the blade holder shown in FIG. 11.
Figure 13:
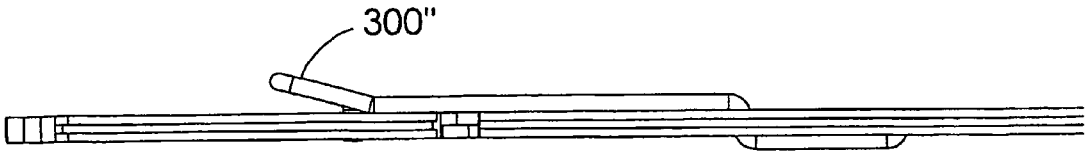
FIG. 13 is a bottom plan view of the portion of the blade holder shown in FIG. 12.
Figure 14:
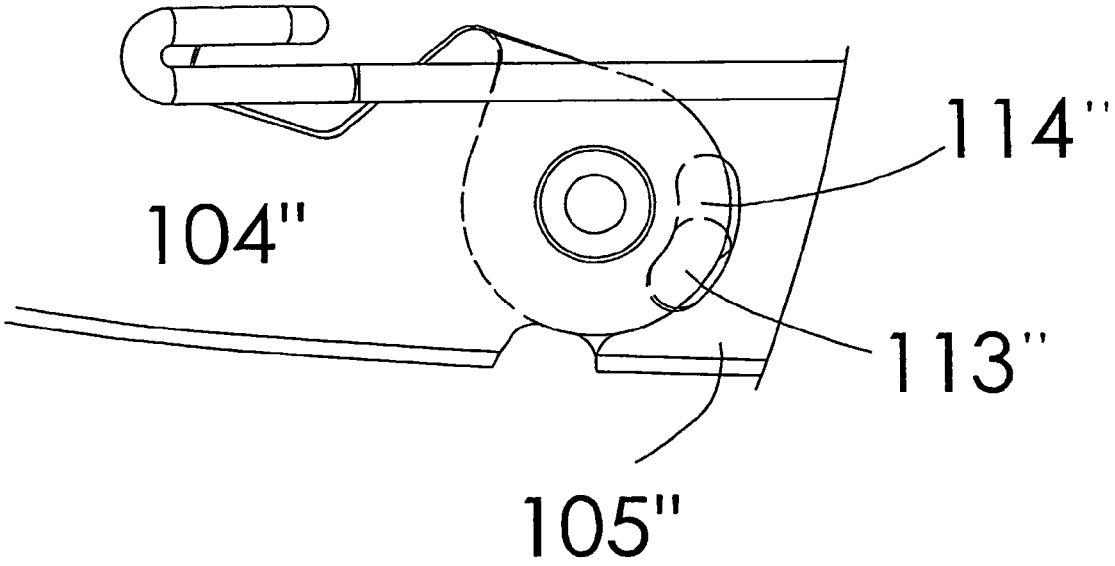
FIG. 14 shows a detail of the blade holder of FIG. 12.

FIGS. 12-14 show a variation of the embodiment of FIG. 11, in which a pin 113" as shown replaces the clip 113' (of FIG. 11), and has a hole 114" (best seen in FIG. 14) as shown through interleaving faces (FIG. 13). A bayonet style locking tab arrangement as described above with reference to tab 155 and hole 156 of FIGS. 9 and 10 may be used. The interleaving faces may interface in the manner described above with respect to interleaving faces 158 mating with 159, and 119 mating with 149, as best seen in FIGS. 9 and 10, and a detailed description is not repeated. Other variations (not shown) are contemplated.

The clip 113' (as described with reference to FIG. 11) may be used in combination with the connection shown in FIGS. 12-14.

A pull handle bend 300' (FIG. 13) may be included; this avoids the need for a tool to pull pin 113" from the hole 114", in order to release the pivoting rear blade holder segment 105" and the blade strip (not shown in FIG. 13). The pull handle 300' may be provided in any configuration that provides a lever arm for easily applying a transverse force for pulling the pin 113" away from the blade holder segment 105".

Figure 15:
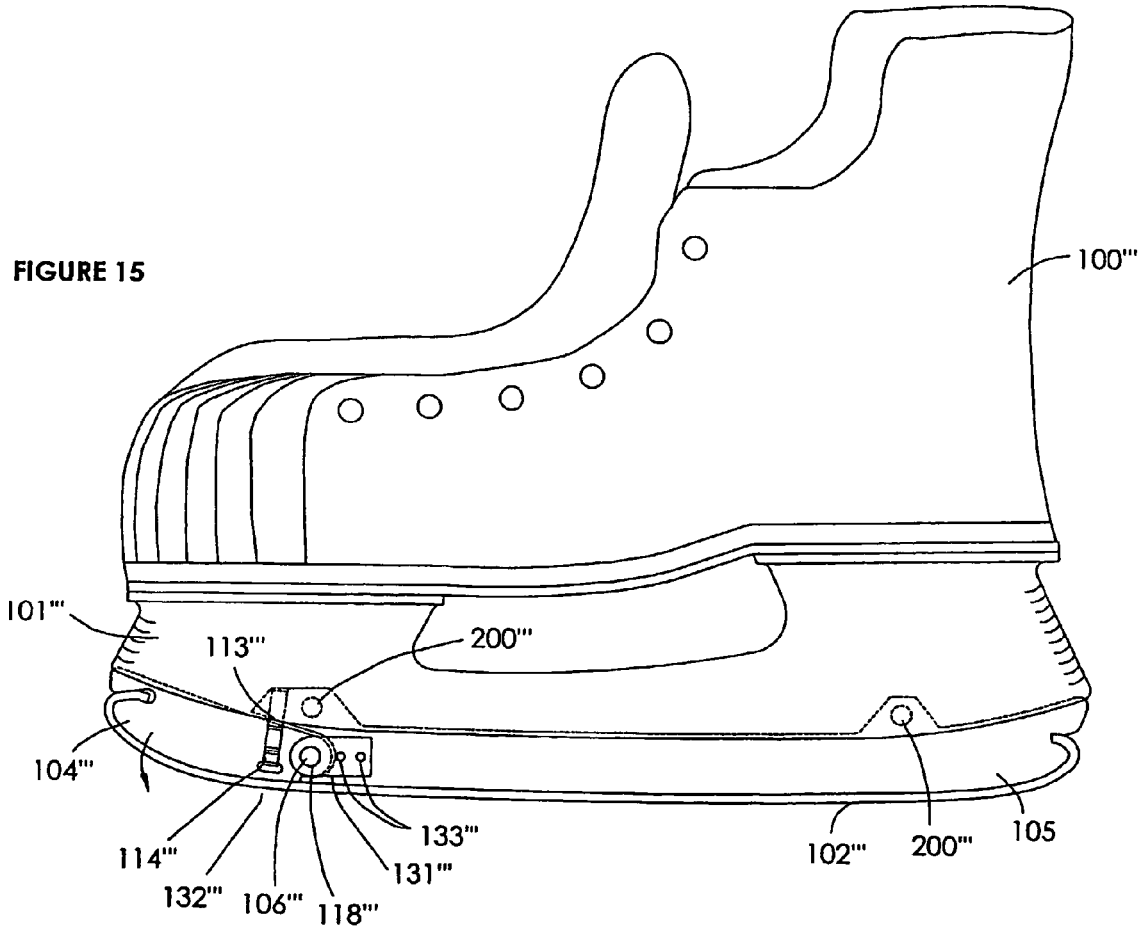
FIG. 15 is a side elevation view of a skate having another exemplary embodiment of the strip blade holder.

FIG. 15 shows a variation of the embodiment shown in FIG. 1, in which items which are like or similar to those described above are indicated by a triple prime ('''), and a description of elements that are the same is not repeated. In this embodiment, the toe segment 104''' rotates around pivot 106''' rather than segment 105''', which is held fixed by fasteners 200''' to plastic superstructure 101'''. This configuration allows the user to hold the foot in a slightly more open position while tensioning the blade strip 102''', which may be more comfortable for some users.

Although the invention has been described in terms of exemplary embodiments, it is not limited thereto. Rather, the appended claims should be construed broadly, to include other variants and embodiments, which may be made by those skilled in the art without departing from the scope and range of equivalents of the invention.

What is claimed is:

1. Apparatus for attaching a replaceable blade to an ice skate, comprising:

a holder adapted to be mounted to a boot;

the holder including a fixed first portion and a second portion pivotally mounted to the first portion;

the first and second portions including means for securing a first end and a second end of the replaceable blade, respectively, wherein the replaceable blade is under tension when the second portion is aligned with the first portion, and the second portion is at an angle with respect to the first portion when the replaceable blade is free from tension; and the holder having a member for fixing the second portion in alignment with the first portion, including a latch biased to automatically lock the second portion when the second portion is moved into alignment with the first portion, wherein the second portion has a slot through which the latch passes when the latch is locked in alignment with the first portion.

2. The apparatus of claim 1, wherein the latch has a protrusion to prevent the latch from being released accidentally from the slot.

3. The apparatus of claim 1, wherein the latch or the second portion is shaped to receive a tool that is used to pry the latch loose.

4. The apparatus of claim 1, further comprising means for providing lateral support between the second portion and the first portion.

5. An ice skate, comprising:

a boot;

a replaceable blade;

a holder mounted to the boot, the holder including a fixed first portion and a second portion pivotally mounted to the first portion;

the first and second portions including means for engaging a first and a second end of the replaceable blade, respectively, wherein the replaceable blade is under tension when the second portion is aligned with the first portion, and the second portion is at an angle with respect to the first portion when the replaceable blade is free from tension; and the holder having a member for locking the second portion in alignment with the first portion, including a latch biased to automatically lock the second portion when the second portion is moved into alignment with the first portion, wherein the second portion has a slot through which the latch passes when the latch is locked in alignment with the first portion.

6. The ice skate of claim 5, wherein the second portion can be moved into alignment with the first portion while the replaceable blade is engaging the holder, by application of about 133 newtons (30 pounds) of downward force on the boot.

7. The ice skate of claim 5, wherein the replaceable blade has approximately 890 newtons (200 lbs) of tension when the second portion is aligned with the first portion.

8. The ice skate of claim 5, wherein the engaging means include respective first and second slots for engaging the first and a second end of the replaceable blade.

9. A method for attaching a replaceable blade to the ice skate of claim 5, the method comprising the steps of:

engaging the first and a second ends of the replaceable blade with the respective first and second portions of the holder, respectively, with the second portion at an angle with respect to the first portion, and with the replaceable blade free from tension;

pivoting the second portion into alignment with the first portion; and latching the second portion in alignment with the first portion.

10. The method of claim 9, further comprising biasing a the latch used to perform the latching, to automatically lock when the second portion is moved into alignment with the first portion.

11. The method of claim 9, further comprising passing the latch through a slot in the holder when the latch is aligned with the first portion.

12. The method of claim 9, further comprising:

inserting a tool in a pocket in the latch; and prying the latch loose from the holder using the tool .

13. The method of claim 9, further comprising moving the second portion into alignment with the first portion while the replaceable blade is engaging the holder, by applying about 133 newtons (30 pounds) of downward force on the boot.

14. The method of claim 9, wherein the replaceable blade has approximately 890 newtons (200 lbs) of tension when the second portion is aligned with the first portion.

15. The method of claim 9, further comprising moving the second portion into alignment with the first portion while the replaceable blade is engaging the holder, by pushing downwards on the holder using a foot that wears the skate.

16. A method for attaching a replaceable blade to the ice skate of claim 5, comprising the steps of:

donning the ice skate;

engaging the first and the second end of the replaceable blade with the respective first and second portions of the holder, respectively, with the second portion at an angle with respect to the first portion, and with the replaceable blade free from tension;

applying onto the skate at least a portion of the weight of a person wearing the ice skate, sufficiently to align the second portion with respect to the first portion; and automatically locking the second portion in alignment with the first portion.

17. The method of claim 16, wherein the weight applying step includes standing while wearing the ice skate.

18. The method of claim 16, wherein the weight applying step includes pushing the replaceable blade against a fixed surface with a foot of the person wearing the skate.

19. Apparatus for attaching a replaceable blade to an ice skate, comprising:

a holder adapted to be mounted to a boot;

the holder including a fixed first portion and a second portion pivotally mounted to the first portion;

the first and second portions including means for engaging a first and a second end of the replaceable blade, respectively, wherein the replaceable blade is under tension when the second portion is aligned with the first portion, and the second portion is at an angle with respect to the first portion when the replaceable blade is free from tension; and the holder has means for fixing the second portion in alignment with the first portion, including a latch biased to automatically lock the second portion when the second portion is moved into alignment with the first portion, wherein the second portion has a slot through which the latch passes when the latch is locked in alignment with the first portion.

20. The apparatus of claim 19, further comprising means for providing lateral support between the second portion and the first portion.

21. Apparatus for attaching a replaceable blade to an ice skate, comprising:

a holder adapted to be mounted to a boot;

the holder including a fixed first portion and a second portion pivotally mounted to the first portion;

the first and second portions including means for engaging a first and a second end of the replaceable blade, respectively, wherein the replaceable blade is under tension when the second portion is aligned with the first portion, and the second portion is at an angle with respect to the first portion when the replaceable blade is free from tension; and the holder has means for fixing the second portion in alignment with the first portion, and a bayonet style locking tab for providing lateral support between the second portion and the first portion.

22. An ice skate, comprising:

a boot;

a replaceable blade;

a holder adapted to be mounted to the boot, the holder including a fixed first portion and a second portion pivotally mounted to the first portion, the first and second portions including means for engaging a first and a second end of the replaceable blade, respectively, the holder having means for fixing the second portion in alignment with the first portion, with the replaceable blade under tension, including a latch biased to automatically lock the second portion when the second portion is moved into alignment with the first portion, wherein the second portion has a slot through which the latch passes when the latch is locked in alignment with the first portion.

23. Apparatus for attaching a replaceable blade to an ice skate, comprising:

a holder adapted to be mounted to a boot;

the holder including a fixed first portion and a second portion pivotally mounted to the first portion;

the first and second portions including means for securing a first end and a second end of the replaceable blade, respectively, wherein the replaceable blade is under tension when the second portion is aligned with the first portion, and the second portion is at an angle with respect to the first portion when the replaceable blade is free from tension; and the holder having a member for fixing the second portion in alignment with the first portion; and a bayonet style locking tab that provides lateral support between the second portion and the first portion.

24. An ice skate, comprising:

a boot;

a replaceable blade;

a holder mounted to the boot;

the holder including a fixed first portion and a second portion pivotally mounted to the first portion;

the first and second portions including means for securing a first end and a second end of the replaceable blade, respectively, wherein the replaceable blade is under tension when the second portion is aligned with the first portion, and the second portion is at an angle with respect to the first portion when the replaceable blade is free from tension; and the holder having a member for fixing the second portion in alignment with the first portion; and a bayonet style locking tab that provides lateral support between the second portion and the first portion.

25. An ice skate, comprising:

a boot;

a replaceable blade;

a holder mounted to the boot;

the holder including a fixed first portion and a second portion pivotally mounted to the first portion;

the first and second portions including means for securing a first end and a second end of the replaceable blade, respectively, wherein the replaceable blade is under tension when the second portion is aligned with the first portion, and the second portion is at an angle with respect to the first portion when the replaceable blade is free from tension; and the holder having means for fixing the second portion in alignment with the first portion; and a bayonet style locking tab that provides lateral support between the second portion and the first portion.

* * * * *